US007032404B2

(12) United States Patent
Kim et al.

(10) Patent No.: US 7,032,404 B2
(45) Date of Patent: Apr. 25, 2006

(54) AIR CONDITIONER

(75) Inventors: Gyu Rak Kim, Changwon-si (KR); Jong Min Ha, Gyeongsangnam-do (KR); Woo Sung Chang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 11 days.

(21) Appl. No.: 10/714,665

(22) Filed: Nov. 18, 2003

(65) Prior Publication Data

US 2004/0144116 A1 Jul. 29, 2004

(30) Foreign Application Priority Data

Jan. 24, 2003 (KR) ..... 10-2003-0004950
Jan. 24, 2003 (KR) ..... 10-2003-0004953
Jan. 27, 2003 (KR) ..... 10-2003-0005365

(51) Int. Cl.
*F25D 23/12* (2006.01)

(52) U.S. Cl. ..... 62/262; 62/404

(58) Field of Classification Search ..... 62/262, 62/285, 298, 404, 407
See application file for complete search history.

(56) References Cited

U.S. PATENT DOCUMENTS 5,638,693 A * 6/1997 Baek ..... 62/262
5,775,123 A * 7/1998 Wakayama et al. ..... 62/407
6,182,460 B1 * 2/2001 Hernandez et al. ..... 62/262
6,412,298 B1 * 7/2002 Kang et al. ..... 62/262

* cited by examiner

*Primary Examiner*—Melvin Jones

(74) *Attorney, Agent, or Firm*—McKenna Long & Aldridge, LLP

(57) ABSTRACT

Disclosed is air conditioner having an indoor part and an outdoor part as one unit. The air conditioner including: an indoor part for inhaling an indoor air to exchange heat with the inhaled air through an indoor heat exchanger, and again discharging the heat-exchanged air into an indoor space; an outdoor part for inhaling an outdoor air to exchange heat with the inhaled air through an outdoor heat exchanger, and again discharging the heat-exchanged air into an outdoor space; a base having parts constituting the indoor part and the outdoor part installed thereon; and a barrier integrated with the base, for partitioning an upper space of the base into the indoor part and the outdoor part.

27 Claims, 13 Drawing Sheets

AIR CONDITIONER

This application claims the benefit of the Korean Application Nos. P2003-0004950 and P2003-0004953 both filed on Jan. 24, 2003 and P2003-0005365 filed on Jan. 27, 2003, which are hereby incorporated by reference.

BACKGROUND OF THE INVENTION

1. Field of the Invention

The present invention relates to an air conditioner, and more particularly, to an air conditioner provided with an indoor part and an outdoor part integrated as one unit.

2. Discussion of the Related Art

Generally, air conditioner is installed at a window or the like of a building to air-condition an inner space of the building.

FIG. 1 is a perspective view illustrating appearance of a conventional air conditioner, and FIG. 2 is a perspective view illustrating an inner construction of a conventional air conditioner.

As shown in FIGS. 1 and 2, the conventional air conditioner includes a bottom base 1 of metal. Both sides and upper surface of the air conditioner are covered with a cabinet 3. The cabinet 3 has both lower ends coupled with both ends of the base 1, and an inner space for installing a variety of devices therein. An outdoor vent louver 4 formed at predetermined portions of the cabinet 3 functions as a passage through which outdoor air enters into the inside of the outdoor part of the air conditioner.

The air conditioner includes a front panel 5 at a front surface thereof, and the front panel 5 includes a vent grill 7. The vent grill 7 functions as a passage through which indoor air enters into the inside of the indoor part of the air conditioner. The front panel 5 has a discharge grill 9 at one side thereof. The heat-exchanged air in the air conditioner is discharged to an indoor space through the discharge grill 9. A filter is provided at a rear side of the vent grill 7 so as to purify the air entering the indoor part of the air conditioner.

An indoor heat exchanger 13 for exchanging heat with the air that has passed through the filter is installed at a rear side of the filter 11. The indoor heat exchanger 13 is installed at an air guide 15 installed on the base 1. The air guide 15 guides indoor side airflow within the air conditioner. Further, the air guide 15 partitions the inside of the air conditioner into the indoor part and the outdoor part in case a separate barrier is not used. An orifice 16 guides the air that has passed through the indoor heat exchanger 13 to an indoor fan 19.

At a rear side of the air guide 15, i.e., at the outdoor part of the air conditioner, a motor 17 is provided. The motor 17 has a rotary shaft extended in bi-directions. One end of the rotary shaft penetrates the air guide 15 to extend to the indoor part, and the other end extends in an opposite direction. The indoor fan 19 is installed at the one end extending to the indoor part, and an outdoor fan 21 is installed at the other end of the rotary shaft. The indoor and outdoor fans 19 and 21 allow the airflow of the indoor part and the air of the outdoor part respectively.

To guide the airflow of the outdoor part, a shroud 23 is installed at the base 1. The shroud 23 has a space for installing the outdoor fan 21 therein to allow air to flow from one side to the other side of the space partitioned by the shroud 23. An outdoor heat exchanger 24 is installed at a rear space partitioned by the shroud 23. Accordingly, if a compressor 25 is driven, the outdoor heat exchanger 24 is heat-exchanged with the outdoor air introduced into the outdoor part through the vent louver 4.

In the meanwhile, the compressor 25 constituting a heat-exchange cycle is disposed at the outdoor part of the base 1. An installation plate disposed below the compressor 25 is fixed to a fixing element installed on the base 1 by welding However, the conventional air conditioner has the following drawbacks.

Since the base 1 is formed of a metallic plate, there is caused a drawback in that the overall weight of the air conditioner is increased. Also, since a number of parts should be individually installed on the base 1, the workability of the assembly process is lowered.

Further, since the air guide 15 installed on the base 1, for partitioning the base 1 into the indoor part and the outdoor part is installed separately from the base 1, there may be caused a drawback in that air leakage between the indoor part and the outdoor part is generated through a gap between the base 1 and the air guide 15 or outdoor noise is transmitted to the indoor space.

On the other hand, the fixing element is installed at the base 1 by a welding or the like. Then, the fixing state of the fixing element may be damaged due to a vibration generated from the compressor, etc. while the compressor is driven. In other words, a welded portion for fixing the fixing element to the base can be damaged due to repetitive vibration. In this case, the noise resulting from the compressor vibration is much increased, and a connection part between the compressor and the refrigerant tube is damaged.

Additionally, once the fixing element is equipped in a completed base pan through a separate process, an assembly process is added so that fabrication costs are increased.

Lastly, since the installation plate is fixed only by the fixing element in a compressor mounting structure, firmness and exactness in fixing is relatively lowered.

SUMMARY OF THE INVENTION

Accordingly, the present invention is directed to an air conditioner that substantially obviates one or more problems due to limitations and disadvantages of the related art.

An object of the present invention is to provide an air conditioner which is light in weight and in which the number of assembly parts is reduced.

Another object of the present invention is to provide an air conditioner for assuring a sealing between an indoor part and an outdoor part.

Another object of the present invention is to provide an air conditioner in which a compressor is more firmly and exactly fixed to a base.

A further object of the present invention is to provide an air conditioner for simplifying a base fabricating process.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an air conditioner including: an indoor part for intaking indoor air to exchange heat with the air through an indoor heat exchanger, and again discharging the heat-exchanged air into an indoor space; an outdoor part for intaking outdoor air to exchange heat with the air through an outdoor heat exchanger, and again discharging the heat-exchanged air into an outdoor space; a base having parts constituting the indoor part and the outdoor part installed thereon; and a barrier integrated with the base, for partitioning an upper space of the base into the indoor part and the outdoor part.

Here, it is desirable that the barrier is further integrated with a shroud being protruded upwardly at one side of the outdoor side base to partition the upper section of the outdoor side base. Further, it is desirable that the barrier is further integrated with a motor loading part being upwardly protruded at one side of the outdoor side base to load a motor thereon. Additionally, it is desirable that the barrier is further integrated with a compressor loading part formed at one side of an upper surface of the outdoor side base to load a compressor thereon.

In another aspect of the present invention, there is provided an air conditioner including: an indoor part for intaking indoor air to exchange heat with the intake air through an indoor heat exchanger, and again discharging the heat-exchanged air into an indoor space; an outdoor part for intaking outdoor air to exchange heat with the intake air through an outdoor heat exchanger, and again discharging the heat-exchanged air into an outdoor space; a base having parts constituting the indoor part and the outdoor part installed thereon; a barrier integrated with the base, for partitioning an upper space of the base into the indoor part and the outdoor part; and a shroud protruded upward of the outdoor side base, for partitioning an upper section of the outdoor side base.

Here, the shroud is separated into an upper side shroud and a lower side shroud, and the lower shroud is integrated with the outdoor side base. Further, the upper side shroud is detachably installed on an upper side of the lower side shroud.

The lower side shroud has vertical-extended reinforcing ribs at both side surfaces thereof, and the reinforcing rib has an inverse-triangular type loading part for guiding mounting of the upper side shroud, at an upper portion thereof.

Further, the shroud has a circular through-hole, and an outdoor fan is provided for the through-hole.

In a further another aspect of the present invention, there is provided an air conditioner including: an indoor part for intaking indoor air to exchange heat with the intake air through an indoor heat exchanger, and again discharging the heat-exchanged air into an indoor space; an outdoor part for intaking outdoor air to exchange heat with the intake air through an outdoor heat exchanger, and again discharging the heat-exchanged air into an outdoor space; a base having parts constituting the indoor part and the outdoor part installed thereon; a barrier integrated with the base, for partitioning an upper space of the base into the indoor part and the outdoor part; and a motor loading part upwardly protruded at one side of the outdoor side base, for loading a motor thereon.

The motor loading part has a support and a recess part, and the motor loading part has a slit for introducing the outdoor air therethrough, at an outdoor side surface thereof.

In a still another aspect of the present invention, there is provide an air conditioner including: an indoor part for intaking indoor air to exchange heat with the intake air through an indoor heat exchanger, and again discharging the heat-exchanged air into an indoor space; an outdoor part for intaking outdoor air to exchange heat with the intake air through an outdoor heat exchanger, and again discharging the heat-exchanged air into an outdoor space; a base having parts constituting the indoor part and the outdoor part installed thereon; a barrier integrated with the base, for partitioning an upper space of the base into the indoor part and the outdoor part; and a compressor loading part for loading a compressor at one side of an upper surface of the outdoor side base.

Here, the compressor loading part includes: fixed protrusions upwardly protruded at the one side of the upper surface of the outdoor side base to pass through an installation plate of the compressor; a supporting rib provided between the fixed protrusions and having a loading groove at an upper surface thereof, the loading groove having a lower side end of the installation plate loaded on an upper surface thereof; and a flexible vibration protecting element having a central part through which the fixed protrusions pass, and provided between a lower surface of the installation plate and the base.

A plurality of the supporting ribs is lined between the fixed protrusions.

Here, the fixed protrusion is formed of a metallic material to have one end fixedly inserted within the base.

In another embodiment, the fixed protrusion is integrated with the base.

On the other hand, the base has a depressed part at a circumference of the fixed protrusion, and the depressed part is shaped to be depressed as much as an area corresponding to the vibration protecting element to load the vibration protecting element thereon.

In a still another aspect of the present invention, there is provided an air conditioner including: an indoor part for intaking indoor air to exchange heat with the intaked air through an indoor heat exchanger, and again discharging the heat-exchanged air into an indoor space; an outdoor part for intaking outdoor air to exchange heat with the intake air through an outdoor heat exchanger, and again discharging the heat-exchanged air into an outdoor space; a base having parts constituting the indoor part and the outdoor part installed thereon; a barrier integrated with the base, for partitioning an upper space of the base into the indoor part and the outdoor part; and an air guide provided at a front surface of the barrier, for guiding an indoor part air and housing an indoor fan.

Here, the air guide includes: a bottom plate forming a bottom part; a rear wall part having an inner surface rounded to guide air passing through an indoor heat exchanger; a side wall part provided at both side ends of the rear wall part; and a fan support formed at the side wall part.

The barrier has an indoor side front surface rounded backwardly and concavely, and the rear wall part is shaped to correspond to the barrier.

Further, the indoor side base having the indoor heat exchanger at a front lower side thereof has a condensed water channel for discharging condensate water, at a front lower side thereof.

Here, the indoor fan is comprised of a crossflow fan, and the air guide has a control box for housing devices for controlling operation of the indoor part and the outdoor part at a side surface thereof, and the control box has a motor cover part at one lower side thereof to surround an upper portion of an indoor motor.

In a still another aspect of the present invention, there is provided an air conditioner including: an indoor part for intaking indoor air at a front surface thereof to again discharge the intake air at the front surface; an outdoor part for intaking outdoor air at both side surfaces and at an upper and lower surfaces thereof to again discharge the intake air to a rear surface thereof; and a barrier for partitioning into an indoor part section and an outdoor part section.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
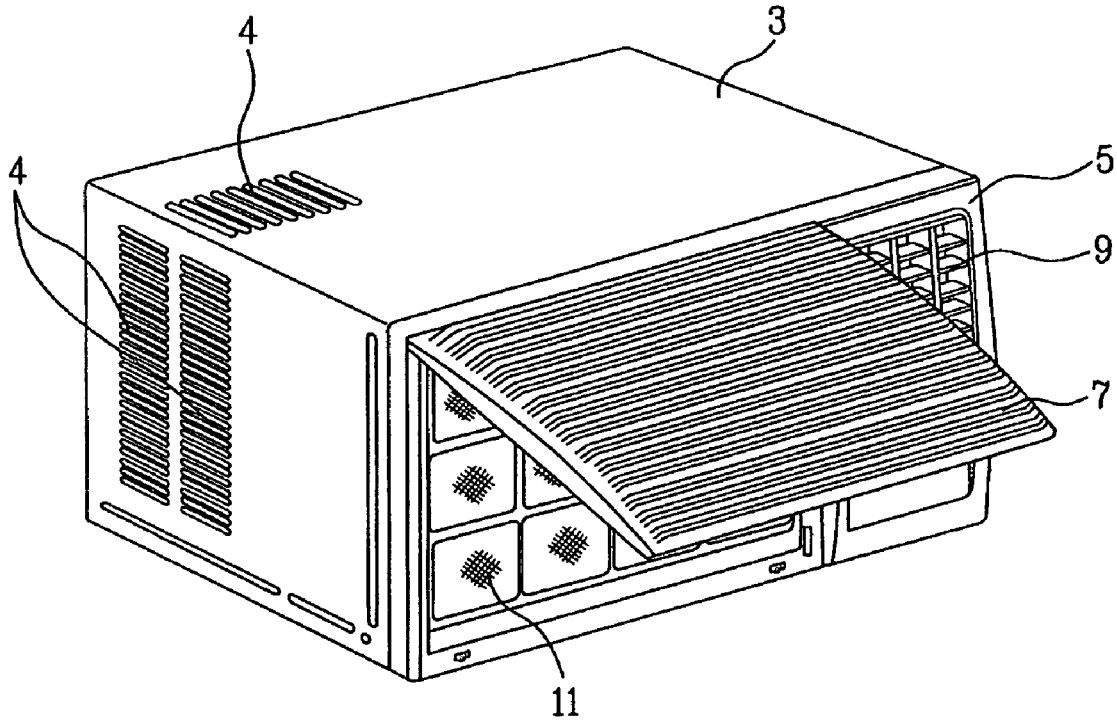
FIG. 1 Prior Art
FIG. 1 is a perspective view illustrating appearance of a conventional air conditioner.
Figure 2:
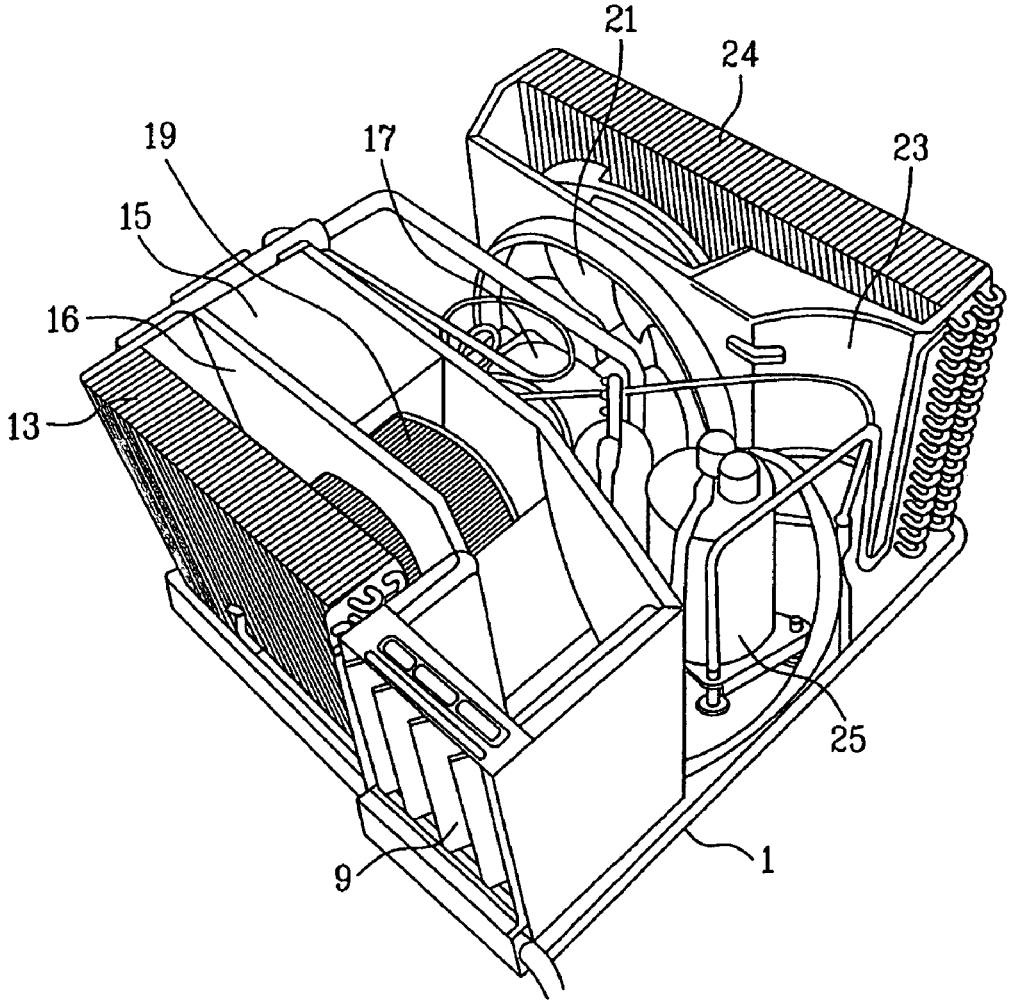
FIG. 2 Prior Art
FIG. 2 is a perspective view illustrating an inner construction of a conventional air conditioner.
Figure 3:
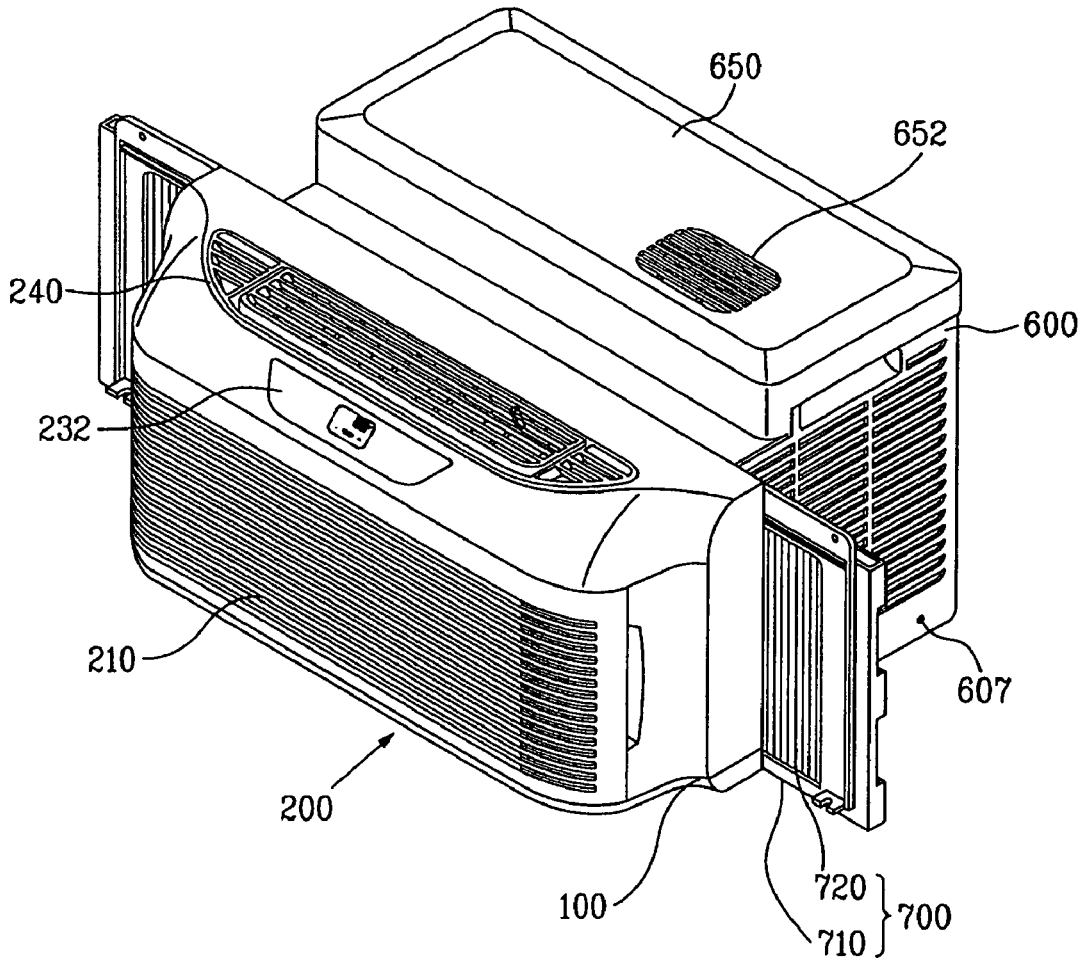
FIG. 3 is a perspective view illustrating an outer construction of an air conditioner in accordance with the present invention.
Figure 4:
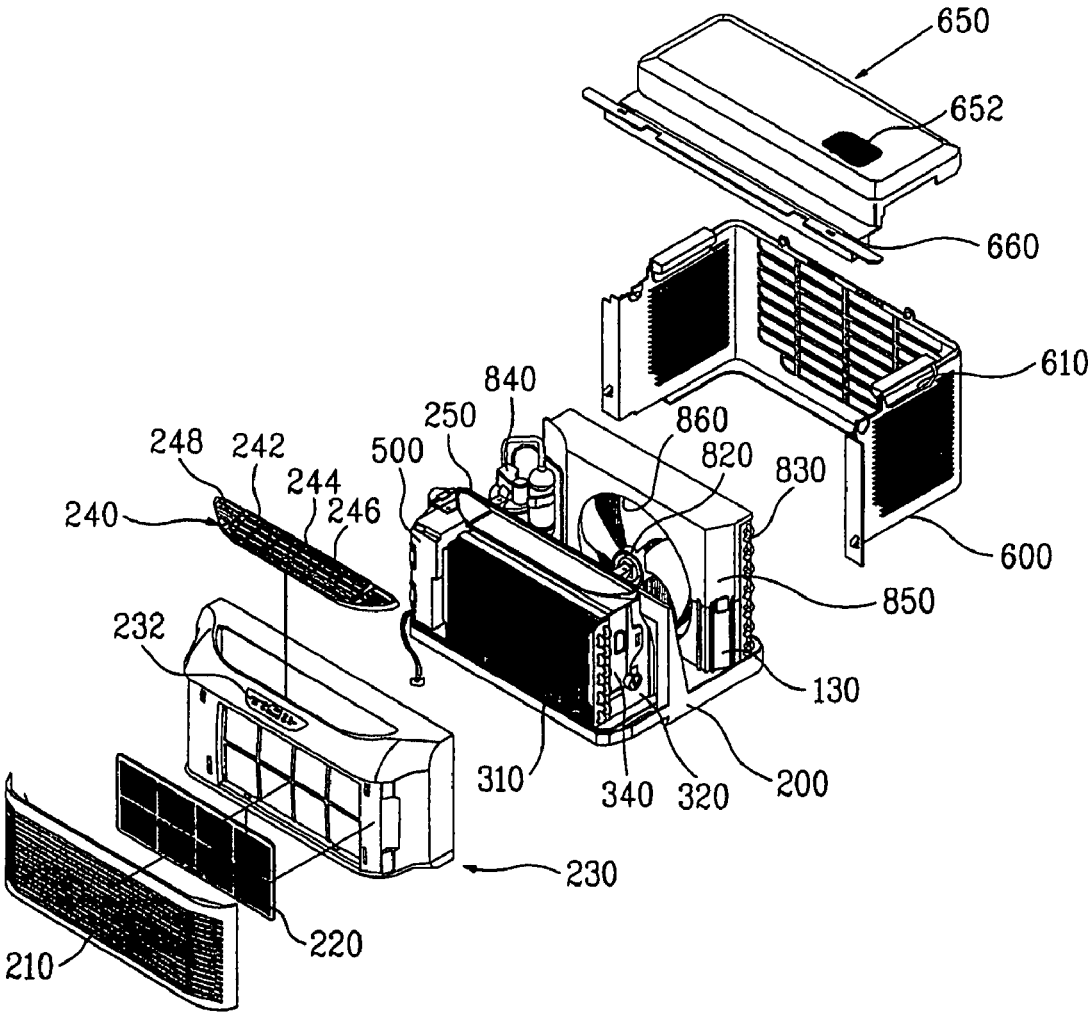
FIG. 4 is an exploded perspective view illustrating an air conditioner in accordance with the present invention.

FIG. 3 is a perspective view illustrating an outer construction of an air conditioner in accordance with the present invention, and FIG. 4 is an exploded perspective view illustrating an air conditioner in accordance with the present invention.

Referring to FIGS. 3 and 4, the air conditioner is configured to include an indoor part, an outdoor part, and a base 110 integrated with a barrier 120.

Hereinafter, an element including the barrier 120 and the base 110 is called a base plate 100. The base 110 includes an indoor side base 110' disposed at a lower portion of the indoor part of the air conditioner and an outdoor side base 110" disposed at a lower portion of the outdoor part.

The indoor part intakes indoor air through an indoor fan to exchange heat with the intake air through an indoor heat exchanger 310, and again discharges the heat-exchanged air to an indoor space. The outdoor part intakes outdoor air through an outdoor fan 820 to exchange heat with the intake air through an outdoor heat exchanger, and again discharges the heat-exchanged air to an outdoor space through a rear surface of the air conditioner. Additionally, the base 110 integrated with the barrier 120 is provided thereon with parts constituting the indoor part and the outdoor part, and is partitioned into an indoor part section and an outdoor part section by the barrier 120.

The air conditioner has an exterior construction comprised of: the base 110 forming a bottom part; a front panel 200 installed at a front portion of the indoor side; a cabinet 600 installed at a rear portion of the outdoor side to form a rear surface and both side surfaces of the air conditioner; and an outdoor side cover 650 coupled with an upper portion of the cabinet 600.

Figure 5:
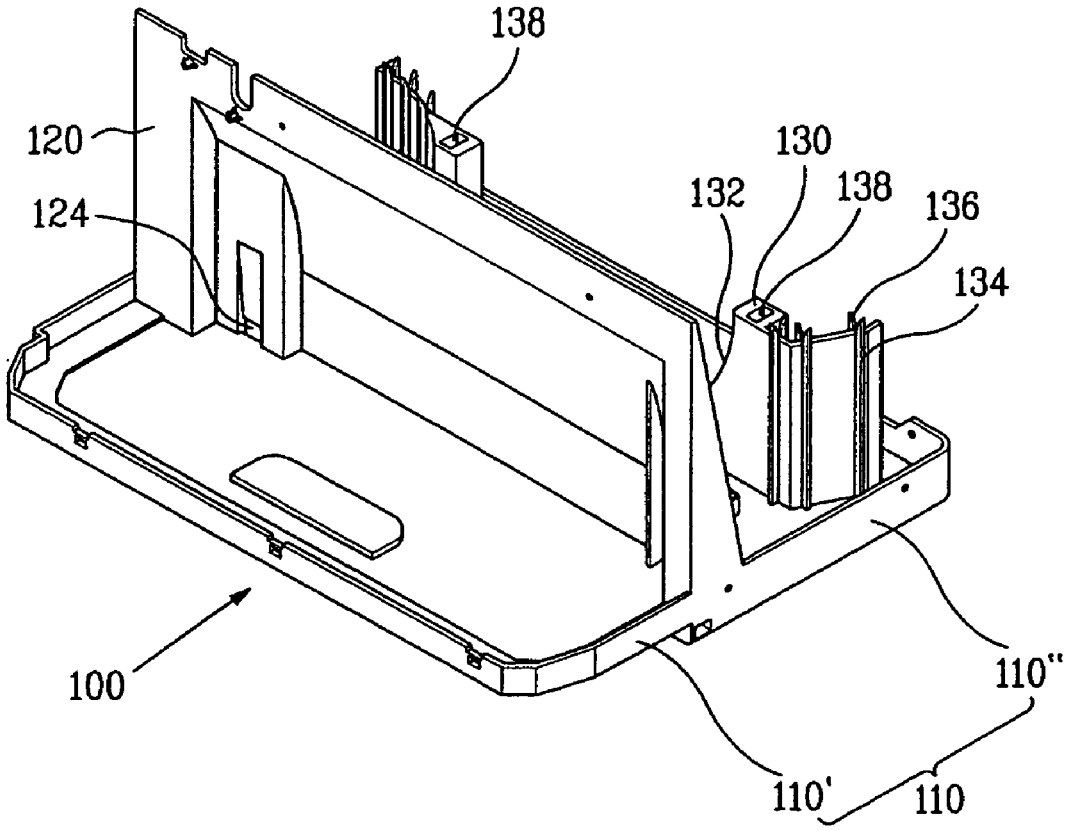
FIG. 5 is a perspective view illustrating a base of an air conditioner drawn centered on an indoor part, in accordance with the present invention.
Figure 6:
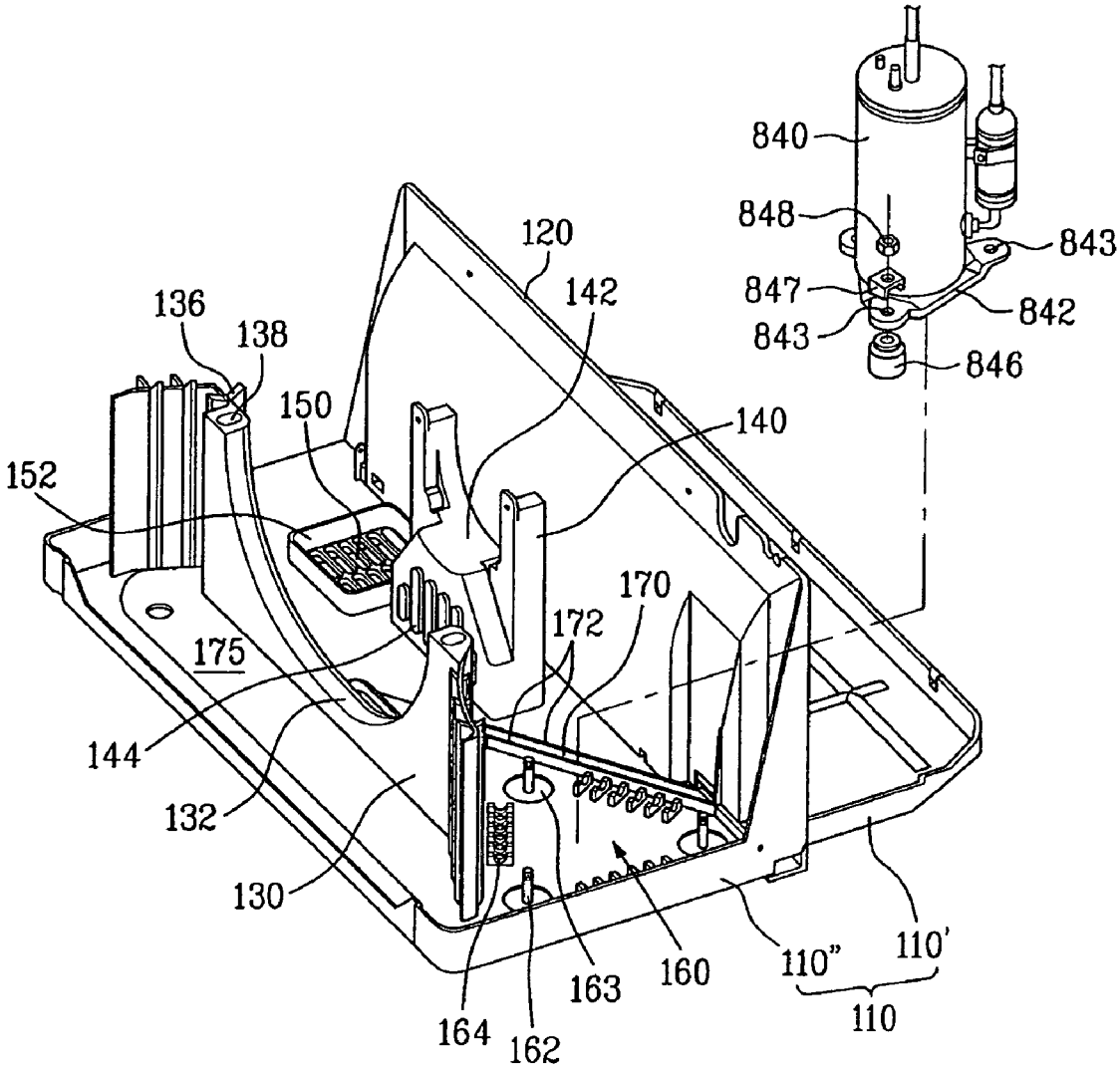
FIG. 6 is a perspective view illustrating a base and compressor mounting structure of an air conditioner drawn centered on an outdoor part, in accordance with the present invention.

FIG. 5 is a perspective view illustrating a base of an air conditioner drawn centered on the indoor part in accordance with the present invention, and FIG. 6 is a perspective view illustrating a base of an air conditioner drawn centered on an outdoor part in accordance with the present invention.

As shown in FIG. 5, a condensed water hole 124 provided at one side of the barrier 120 serves as a passage through which the water condensed in the indoor part flows to the outdoor part. Herein, the bottom of the air conditioner is comprised of the base 110. The base 110 is injection-molded using a material such as resin or the like and is preferably integrated with the barrier 120 for partitioning the space of the base into the indoor part section and the outdoor part section.

The base 110 is divided into the indoor side base 110' corresponding to a front portion of the barrier 120 formed long in a horizontal direction, and the outdoor side base 110" corresponding to a rear portion of the barrier 120. When the air conditioner is installed at a window of a building, the indoor side base 110' is disposed at an indoor space and the outdoor side base 110" is disposed at an outdoor space.

The barrier 120 partitions the air conditioner into the indoor part and the outdoor part, and has a front surface rounded backwardly and concavely to install a rear wall part 324 of a lower side air guide 320 to be described below.

The outdoor side base 110" has a lower side shroud 130 upwardly protruded and integrated therewith, and the lower side shroud 130 has an upper side shroud (reference numeral 850 of FIG. 13) detachably coupled with an upper side thereof. The lower side shroud 130 has a semicircular part 132 forming a lower half part of a through-hole 860, at an upper portion thereof. The upper side shroud 850 and the lower side shroud 130 are coupled with each other to form the through-hole 860 having a central part communicated, and a ventilation fan 820 is provided at the through-hole 860.

On the other hand, as shown in FIG. 5, the lower side shroud 130 has an up and down extended reinforcing rib 134 at a side surface thereof to reinforce a strength of the lower side shroud 130. The reinforcing rib 134 is symmetrized with both surfaces of the lower side shroud 130.

Figure 7:
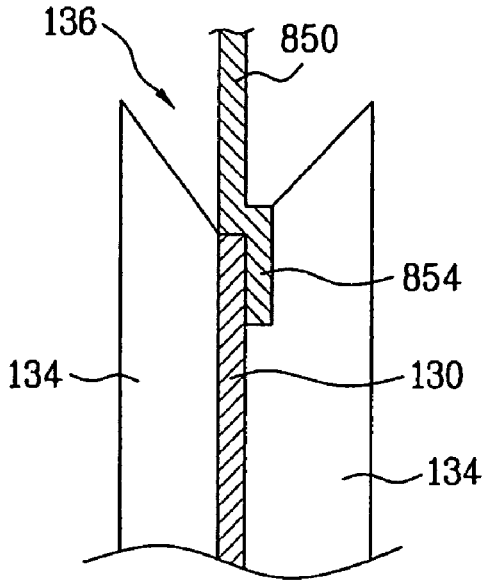
FIG. 7 is an enlarged view illustrating a connection structure of a shroud in accordance with the present invention.

Referring to FIG. 7, the reinforcing rib 134 has a loading part 136 depressed in the shape of an inverse triangle at an upper portion thereof such that the upper side shroud 850 is easily installed up to down. The semicircular part 132 of the lower side shroud 130 has an insertion hole 138 at both ends thereof, and an insertion protrusion 856 of the upper side shroud (reference numeral 850 of FIG. 13) is inserted into the insertion hole 138.

As shown in FIG. 6, a motor loading part 140 is formed between the lower side shroud 130 and the barrier 120 to be protruded upwardly from the outdoor side base 110". The motor loading part 140 has a semicircular recess-shaped recess part 142 downwardly depressed at an upper portion thereof, and an outdoor motor (reference numeral 810 of FIG. 12) is installed at the recess part 142. Herein, it is desirable that the motor loading part 140 is integrated with the base 110.

The motor loading part 140 has an internal space therein, and the internal space is communicated with an external. Further, a plurality of through-slits 144 is formed at a shroud side surface of the motor loading part 140. Accordingly, the outdoor air is introduced into the outdoor part from the lower portion of the base 110 through the slits 144.

As shown in FIG. 6, the motor loading part 140 has a lower grill 150 passing through the outdoor side base 110" at an adjacent portion thereof, and the lower grill 150 has an upward-protruded extension part 152 at an edge portion thereof. Accordingly, the outdoor air can enter through the slits 144 and the lower grill 150.

At another adjacent portion of the motor loading part 140 is formed a compressor loading part 160. The compressor loading part 160 includes a fixed protrusion 162 and a supporting rib 164. Herein, it is desirable that the compressor loading part 160 is integrated with the base 110.

The fixed protrusion 162 is protruded upwardly from an upper surface of the outdoor side base 110". At this time, it is desirable that three fixed protrusions 162 are provided to form an angular point of an approximate regular triangle. Further, a depressed part 163 is formed at a circumference of the fixed protrusion 162.

An installation plate 842 provided at a lower portion of the compressor 840 uses a triangular plate to cover the fixed protrusions 162 formed at the compressor loading part 160, and has a mounting hole 843 having the fixed protrusion 162 passing therethrough, at an angular point portion thereof. The fixed protrusion 162 passing through the mounting hole 843 of the installation plate 842 has a washer 847 and a fixing nut 848 coupled with an upper portion thereof.

Referring to FIG. 6, the depressed part 163 is provided with a vibration protecting element 846, and the fixed protrusion 162 passes through a center of the vibration protecting element 846. The vibration protecting element 846 supports a lower surface of the installation plate 842 at an upper portion thereof. The depressed part 163 is provided with the vibration protecting element 846 having elasticity so as to support the installation plate 842 such that vibration of the compressor 840 is reduced. Herein, it is desirable that the vibration protecting element 846 is formed of a flexible material such as rubber or an elastic material so as to absorb the vibration.

Figure 8A:
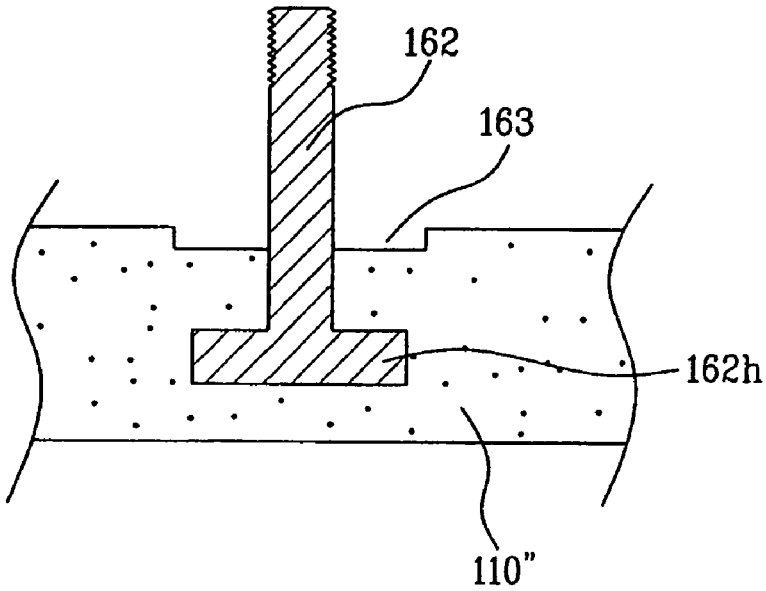
FIG. 8A is a sectional view illustrating a compressor mounting structure in accordance with one embodiment of the present invention.

As shown in FIG. 8A, it is desirable that the fixing protrusion 162 is formed of a metal, and the fixing protrusion 162 has one end provided with a head part **162*h* fixedly inserted into a metallic mold when the base 110 is molded. That is, the fixed protrusion 162 has a circular head part (not shown) inserted into the outdoor side base 110"** at the time of injection-molding, at a lower portion thereof.

Figure 8B:
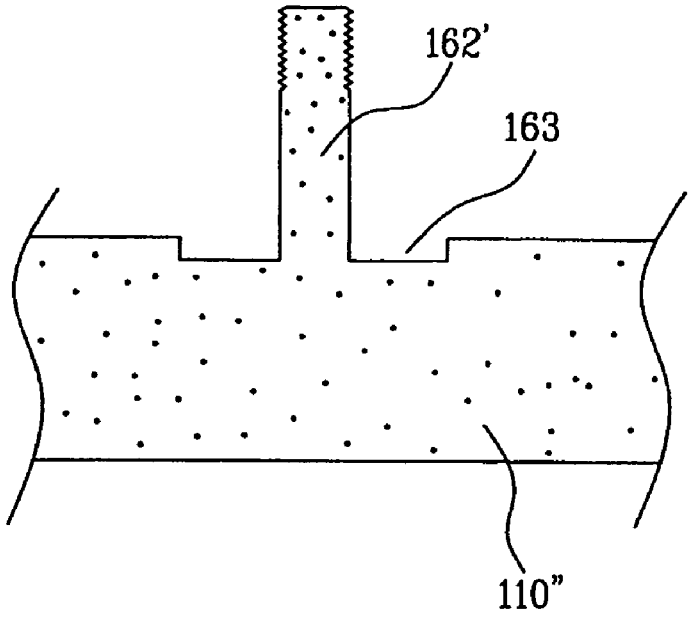
FIG. 8B is a sectional view illustrating a compressor mounting structure in accordance with another embodiment of the present invention.

FIG. 8B illustrates another embodiment of the fixed protrusion, and a fixed protrusion 162' can be also integrated with the base 110 using the same material.

Figure 8C:
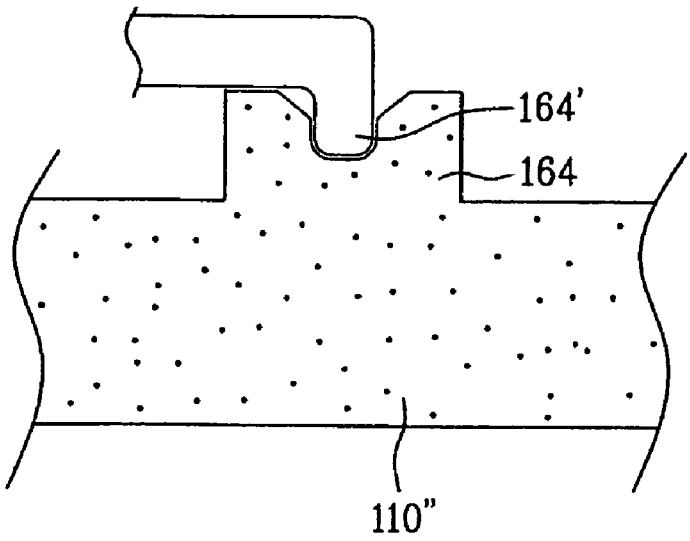
FIG. 8C is a sectional view illustrating a compressor mounting structure in accordance with the present invention.

As shown in FIG. 8C, between the fixed protrusions 162 is formed the supporting rib 164 protruded upwardly from the outdoor side base 110". A loading groove 164' provided at an upper surface of the supporting rib 164 is coupled with the below-described bottom surface of the installation plate of the compressor 840.

The outdoor side base 110" is provided with a condensed water channel 170 for guiding the condensate water transmitted to the outdoor part through the condensate water hole 124. The condensed water channel 170 is provided between guide ribs 172 protruded at a distance away from each other. The condensed water channel 170 passes through a lower portion of the lower side shroud 130 to be connected with a condensate water collecting part 175 concaved between the rear end of the outdoor side base 110" and the lower side shroud 130.

On the other hand, the base 110 has a front panel 200 installed at an indoor side front thereof. The front panel 200 includes a vent grill 210 functioning as a passage for introducing the indoor air therethrough; an air filter 220 provided at a rear of the vent grill 210; a front surface frame 230 having the vent grill 210 disposed thereat; and a discharge frame 240 disposed at an upper portion of the front surface frame 230.

The upper portion of the front surface panel 200 is slanted, and the slanted surface is provided with a display part 232. The display part 232 displays operation and indoor air-conditioning states, etc. of the air conditioner.

The discharge frame 240 is integrated with a grill part 242, and a discharge grill 244 having the air discharged to the indoor space passing therethrough is detachably provided between the grill parts 242. Additionally, the discharge grill 244 has a plurality of horizontal ribs 248 at left and right sides thereof for controlling a discharge direction of the air and preventing insertion of a finger, etc. The horizontal rib 248 has a vertical rib 246 for guiding flow of the discharged air controllably disposed at a lower portion thereof. Further, the discharge frame 240 has a discharge guide 250 for guiding the flow of the discharged air at a lower surface thereof.

The front surface panel 200 has an indoor heat exchanger 310 corresponding to a vaporizer, at a rear thereof. The indoor heat exchanger 310 is installed at a front side upper surface of a lower side air guide 320 so as to exchange heat with the air which enters through the vent grill 210.

Figure 9:
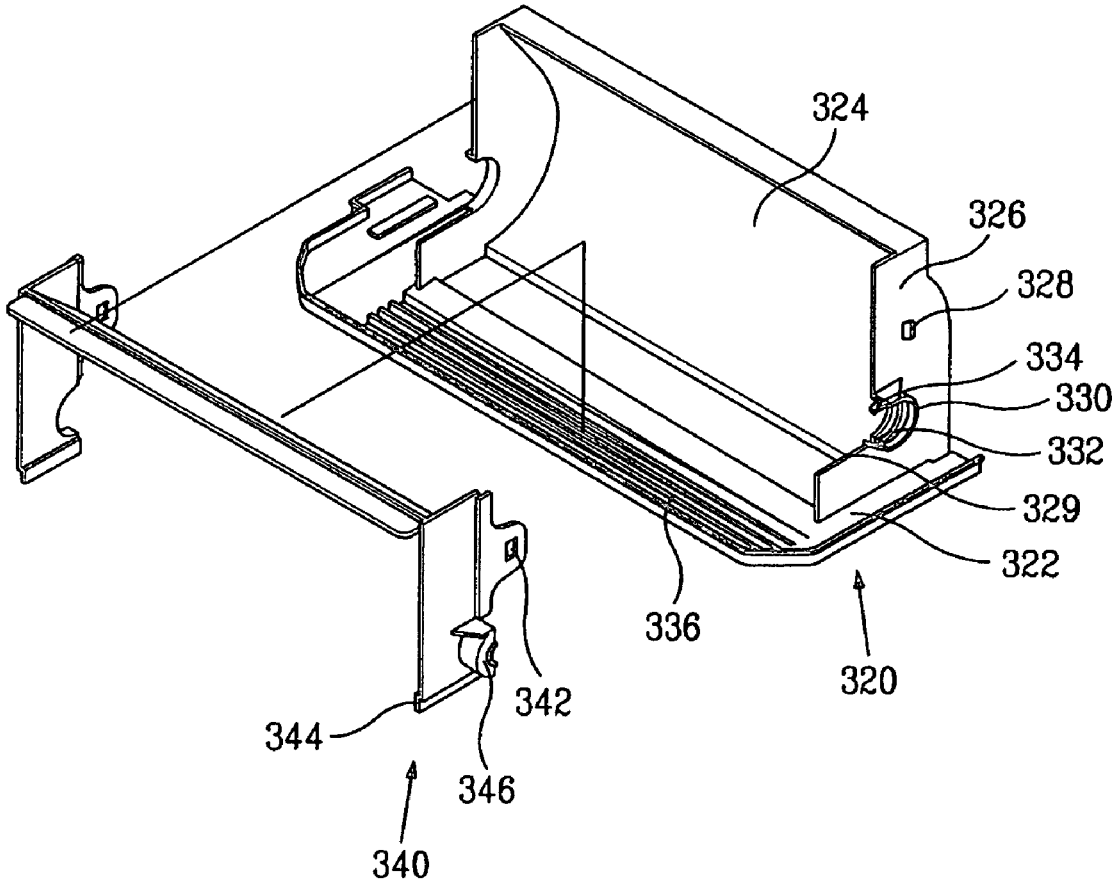
FIG. 9 is a perspective view illustrating an air guide of an air conditioner in accordance with the present invention.

As shown in FIG. 9, the lower side air guide 320 includes a bottom plate 322 forming a bottom surface; a rear wall part 324 connected with a rear end of the bottom plate 322 to have an inner surface rounded concavely; and a side wall part 326 extended from both side surfaces to the front of the rear wall part 324.

The side wall part 326 has a latch protrusion 328 coupled with a latch hole 342 of the upper side air guide 340. Further, the right side wall part 326 has a semicircular recess-shaped lower side fan support 330. A semicircular protrusion 332 is formed along the semicircular recess at the lower side fan support 330 to allow a bearing assembly 440 to be inserted. The lower side fan support 330 has a fixed rib 334 for fixing to prevent the bearing assembly 440 from being disconnected, forward-protruded at an upper portion thereof.

The rear wall part 324 is rounded backward and concavely so as to guide the intake air. Further, the front surface of the barrier 120 is rounded backward and concavely in a corresponding shape to the rear wall part. The bottom plate 322 has a condensed water channel 336 at a front thereof. The condensed water channel 336 collects the condensate water from the indoor heat exchanger 310 disposed at the upper portion thereof.

The lower side air guide 320 is coupled with the upper side air guide 340, and the upper side air guide 340 has the discharge guide 250 communicatively provided at an upper portion thereof. The latch hole 342 provided at a side surface of the upper side air guide 340 is fixedly coupled with the latch protrusion 328 formed at the side wall part 326 of the lower side air guide 320.

The upper side air guide 340 has a bent surface 344 at both side lower ends thereof, and the bent surface 344 is coupled for a good contact with the front upper surface 329 of the side wall part 326 of the lower side air guide 320 to effectively shield the air leakage.

The upper side air guide 340 has the upper side fan support 346 formed at a side surface thereof to be connected with the lower side fan support 330 integrated with the side wall part 326 of the lower side air guide 320 to support the indoor fan 410.

Figure 10:
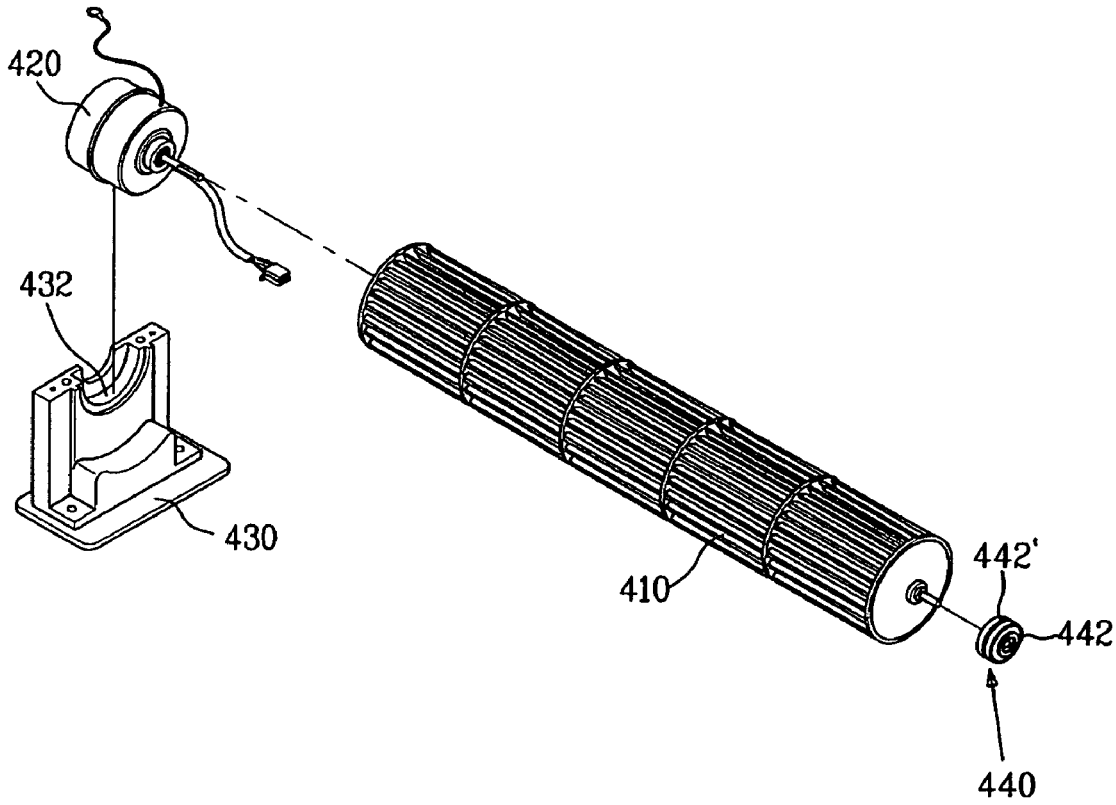
FIG. 10 is a perspective view illustrating an indoor fan and an indoor motor of an air conditioner in accordance with the present invention.

As shown in FIG. 10, the indoor fan 410 is comprised of a crossflow fan for ventilating the intake air in a circumference direction, and the ventilated air is guided by the upper side and lower side air guides 320 and 340 and the discharge guide 250 to be discharged to the indoor space through the discharge grill 244.

The indoor fan 410 has an indoor motor 420 for rotating the indoor fan 410 at a left side thereof. The indoor motor 420 is disposed at the indoor motor loading parts 140 and 430 coupled to the base 110. The indoor motor 420 is disposed at the indoor motor loading parts 140 and 430 coupled to the base 110. The indoor motor 420 is disposed at a mounting surface 342 that is formed at upper portions of the indoor motor loading parts 140 and 430 to have a semicircular recess shape depressed downwardly.

The indoor fan 410 has the bearing assembly 440 disposed at a right axis thereof. The bearing assembly 440 includes a bearing inserted thereinto; and a bearing cover 442 formed of a rubber material enclosing the bearing. The bearing cover 442 has an insertion recess 442' formed along a circumferential surface such as a pulley shape, at a circumference surface thereof. The semicircular protrusion 332 of the lower side fan support 330 is coupled to the insertion recess 442'. The indoor motor loading parts 140 and 430 have a control box 500 having each kind of parts for controlling the air conditioner disposed therein, at a left side thereof.

Figure 11:
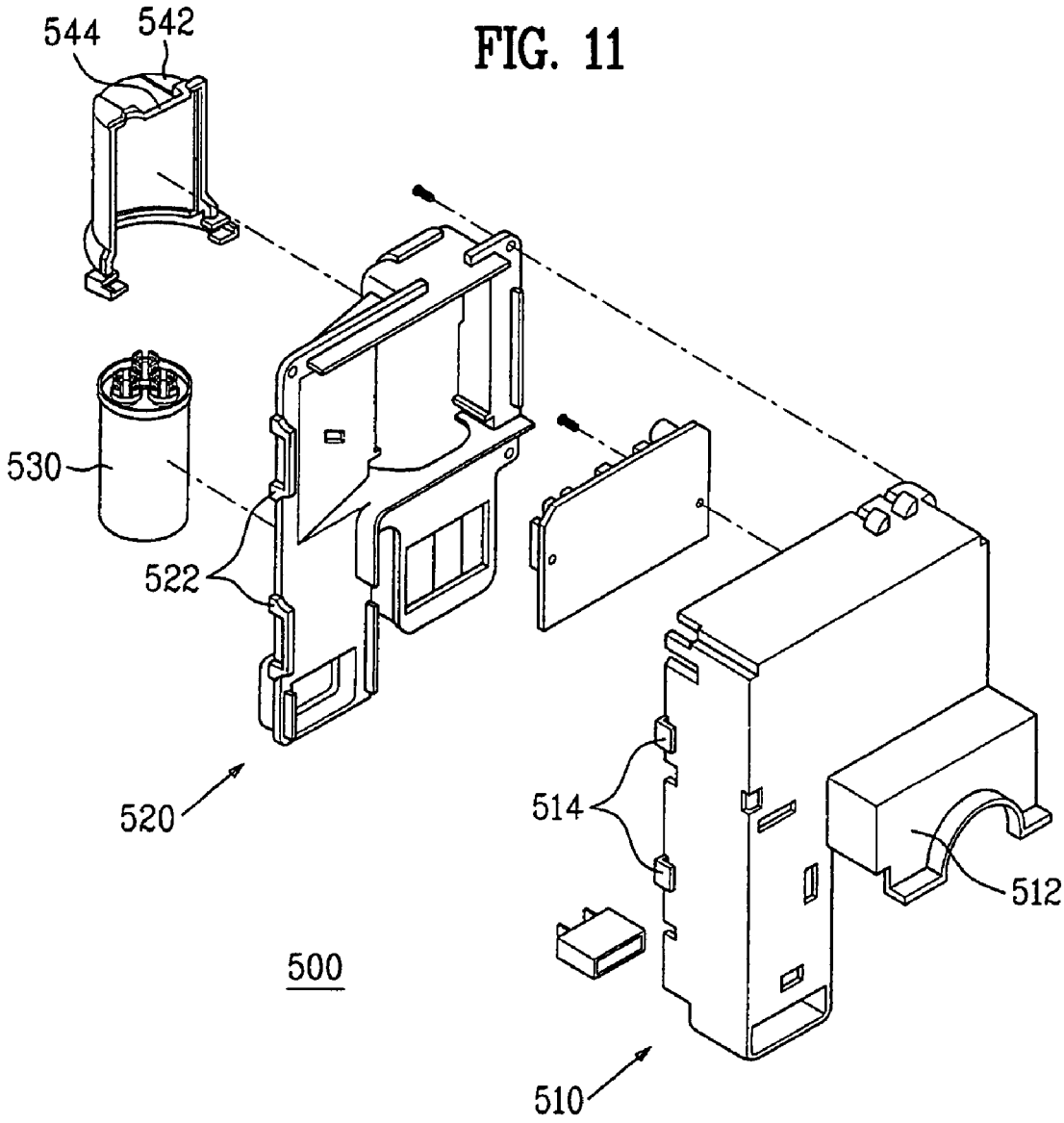
FIG. 11 is an exploded perspective view illustrating a control box of an air conditioner in accordance with the present invention.

As shown in FIG. 11, the control box 500 is comprised of a body part 510 and a cover part 520, and the body part 510 is box-shaped, and includes the motor cover part 512 for enclosing an upper portion of the indoor motor 420 at a right side thereof. Additionally, the body part 510 has combination latches 514 formed at a distance up and down at a front surface left side end thereof.

An opened portion of the body part 510 is covered with the cover part 520. Combination recess parts 522 formed at a distance up and down at a front end of the cover part 520 are coupled with the combination latches 514 of the body part 510. Accordingly, the cover part 520 can be opened and closed while being rotated with respect to an axis of the combination portion.

The cover part 520 further has a capacitor mounting part for mounting a capacitor 530 at a left side surface thereof. The capacitor mounting part is formed at an exterior surface lower side of the cover part 520. A capacitor cover 542 is provided to open and close connection lines provided at an upper portion of the capacitor 530 installed at the capacitor installation part. The capacitor cover 542 has an upper portion coupled to an upper portion of the cover part 520, and has a lower portion inserted into a lower portion of the capacitor mounting part for combination.

On the other hand, the outdoor side has a cabinet 600 forming an exterior part of an outdoor rear surface and a side surface of the air conditioner, and the cabinet 600 is disposed along an edge portion of the outdoor side base 110". The outdoor air enters or discharges through the grill part formed at a rear surface and a side surface of the cabinet 600. The cabinet 600 has a grip 610 for facilitating to handle the air conditioner, at a side surface upper portion thereof.

The cabinet 600 has an outdoor side cover 650 disposed at an upper portion thereof. In front of the outdoor side cover 650, a cover step part 660 is installed, and a below-described curtain frame 710 of a curtain assembly 700 is installed at the cover step part 660.

The cabinet 600 has a vent grill part for intaking the outdoor air therethrough, at both side surfaces thereof. The outdoor side cover 650 also has a certain-sized cover grill part 652 at an upper surface thereof. The cover grill part 652 of the outdoor side cover 650 also functions as the passage for intaking the outdoor air therethrough.

On the other hand, the curtain assembly 700 shields a gap between the air conditioner and the window, and is comprised of the curtain frame 710 and the curtain 720. The curtain frame 710 is slidably disposed along a space between the outdoor side cover 650 and the base 110. That is, the curtain frame 710 is slidably inserted into both side ends of the barrier in a horizontal direction such that in case the air conditioner is disposed at the window, the gap is shielded between the air conditioner and the window to thereby shield the airflow between the indoor and outdoor spaces. The base 110 has a mounting part into which a lower portion of the curtain frame 710 is inserted for sliding, at an upper surface one side thereof.

Figure 12:
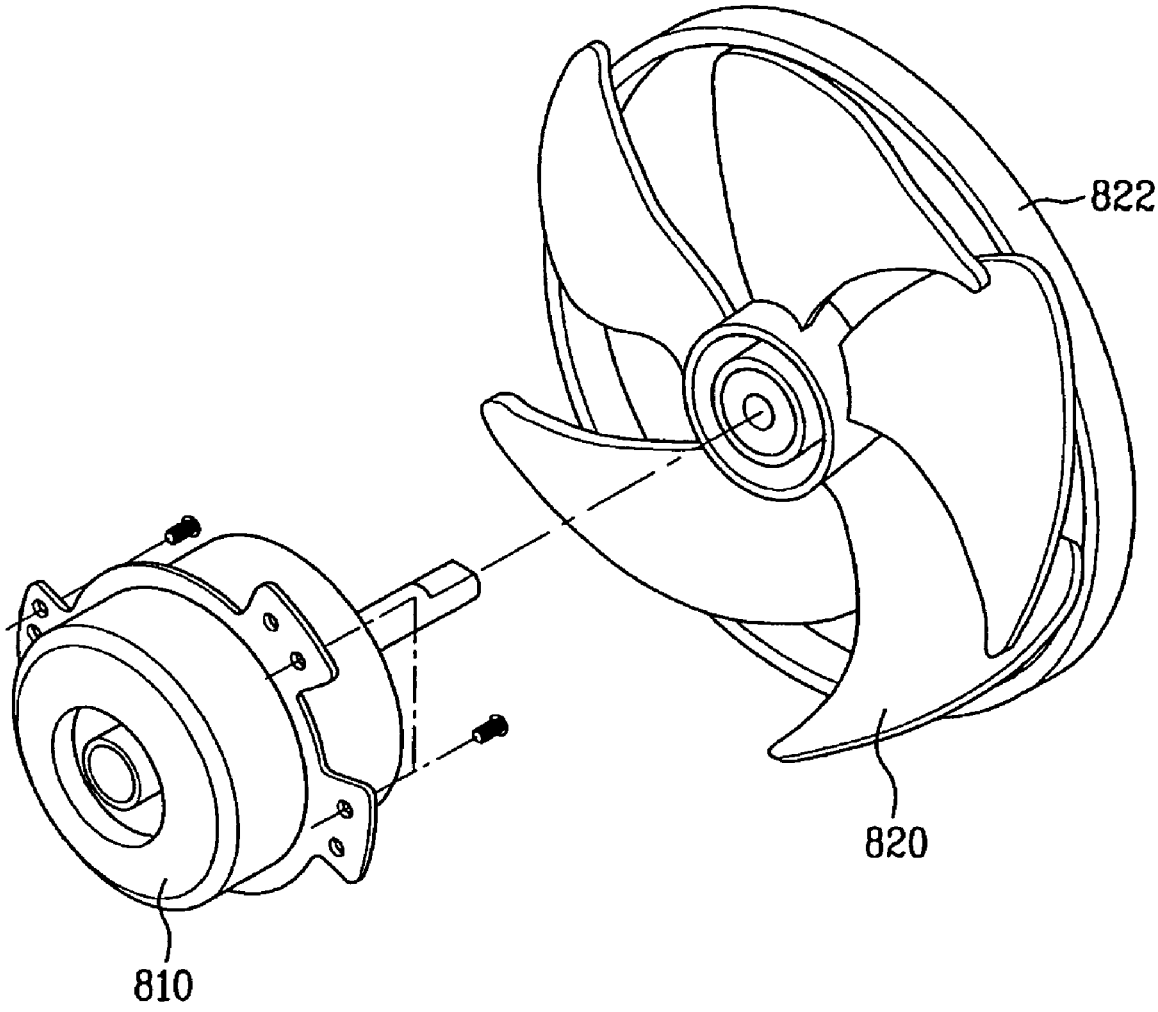
FIG. 12 is a perspective view illustrating an outdoor fan and an outdoor motor of an air conditioner in accordance with the present invention.

As shown in FIG. 12, the motor loading part 140 integrated on and with the outdoor side base 110" has an outdoor motor 810 installed thereon, and a rotary axis of the outdoor motor 810 is provided with the outdoor fan 820 for allowing the air of the outdoor part to flow.

A fan ring 822 provided to connect wing end portions of the outdoor fan 820 with one another flips the condensate water collected on the base 110 to sprinkle on the outdoor heat exchanger 830 installed at a rear of the outdoor fan 820.

The condensate water condensed at a surface of the indoor heat exchanger 310 to be transmitted to the outdoor part is at a low temperature, and the condensate water is sprinkled on the outdoor heat exchanger 830 in a cooling mode such that the outdoor heat exchanger 830 is reduced in a temperature to thereby improve a cooling efficiency.

Figure 13:
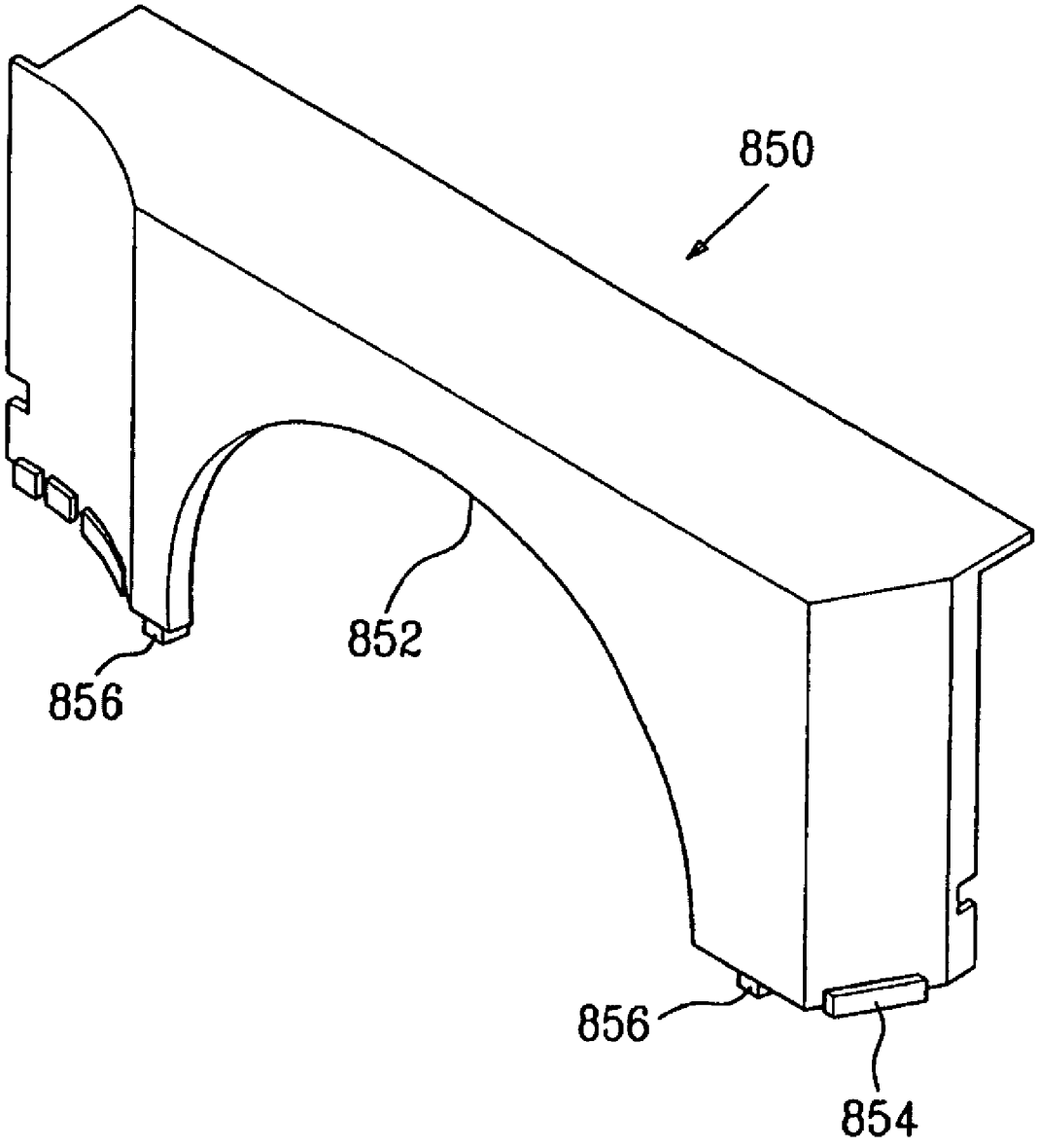
FIG. 13 is a perspective view illustrating an upper side shroud of an air conditioner in accordance with the present invention.

As shown in FIG. 13, the lower side shroud 130 formed at the base 110 has the upper side shroud 850 disposed at an upper portion thereof. The upper side shroud 850 has an upper side semicircular part 852 corresponding to the semicircular part 132 formed at the lower side shroud 130.

Accordingly, the upper and lower side shrouds are coupled with each other to form the through-hole 860 communicating with the outdoor heat exchanger 830 side, and the outdoor fan 820 is disposed at the through-hole 860. It is desirable that the outdoor fan 820 is comprised of the crossflow fan correspondingly to a shape of the through-hole 860.

The upper side shroud 850 has a stepped part 854 at a lower portion thereof. The stepped part 854 is downwardly extended by a certain length from one surface of the lower side shroud 850 to be in contact with one surface of the lower side shroud 130. The stepped part 854 is formed not to interfere with the mounting part 136. The upper side shroud 850 has the insertion protrusion 856 correspondingly to a position of the insertion hole 138, at a lower portion thereof. The insertion protrusion 856 is fixedly inserted into the insertion hole 138 such that the upper side shroud 850 is coupled with the lower side shroud 130.

Hereinafter, an operation of the air conditioner in accordance with the present invention will be described as constructed above.

The inventive air conditioner can be operated in a cooling or heating mode, but the case in which the cooling mode operates will be exemplified hereinafter. In the cooling mode, the air conditioner discharges indoor heat to the outdoor space.

If the air conditioner is driven, the indoor fan 410 rotates while intaking the indoor air through the vent grill 210 of the front surface panel 200 in the indoor part. The intake air is purified by the air filter 220, and is heat-exchanged with the indoor heat exchanger 310. The air cooled passing through the indoor heat exchanger 310 enters into the indoor fan 410.

The air again discharged in the circumference direction from the indoor fan 410 is guided along the air guides 320 and 340 while being flowed to the discharge guide 250. The air flowing into the discharge guide 250 is discharged into the indoor space through the discharge grill 244. After that, the air circulates the indoor space to cool the indoor space, and then enters into the air conditioner through the vent grill 210 to repeat the heat-exchange procedure.

On the other hand, in the outdoor part, a refrigerant absorbing the heat at the indoor heat exchanger 310 is transmitted to the outdoor heat exchanger 830 to be heat-exchanged with the outdoor air while allowing the heat to be discharged to the external.

If the outdoor fan 820 is driven and rotated by the outdoor motor 810, the outdoor air enters between the shrouds 130 and 850 and the barrier 120 through the vent grill part, the cover grill part 660 and the lower grill 150 of the cabinet 600. The air guided between the shrouds 130 and 850 and the barrier 120 passes through the outdoor heat exchanger 830 by the outdoor fan 820 while absorbing the heat to be discharged to the rear of the cabinet 600.

On the other hand, the base 110 of the inventive air conditioner is formed of the material of resin, etc., and it is desirable that the base pan 100 is integrated with the barrier 120, the lower side shroud 130, the compressor loading part 160 and the outdoor motor loading part 140. Accordingly, when the air conditioner is assembled, the barrier 120, the lower side shroud 130, and the outdoor motor loading part 140 do not need to be assembled separately, and the upper side shroud 850, etc. can be simply assembled with an upper surface of the base 110.

In the inventive outdoor part, the outdoor air enters the indoor side of the air conditioner even through the lower grill 150 formed at the base 110 and the slit 144 formed at the motor loading part 140. Further, the outdoor air enters even through the cover grill part 652 formed at an upper surface of the outdoor side cover 650 and both side surfaces of the cabinet 600. Accordingly, while the air conditioner operates, an amount of the air transmitted to the outdoor heat exchanger 830 is increased.

As described above, the inventive integrated type air conditioner has the following effects.

The assembled parts are reduced in number, and a work process is reduced in number since the base of the inventive air conditioner is integrated with the barrier and the lower side shroud, etc. In addition, the air leakage or noise transmission is shield from between the indoor part and the outdoor part to thereby improve adiabatic and soundproof characteristics since the parts are integrated with one another.

Further, efficiency of the air conditioner can be increased since the lower grill, etc. is formed to intake the outdoor air through the base such that the air amount can maximally enter the outdoor part.

Furthermore, the inventive air conditioner is reduced in a total weight and is facilitated to handle since the base is formed of the material of the resin, etc.

Additionally, the inventive air conditioner simplifies the manufacturing process of the base since the fixed protrusion for disposing the compressor at the base is inserted into the metallic mold at the time of injection-molding of the base to be integrated with the base.

Further, the noise can be reduced since a plurality of the supporting ribs is formed to support the end of the installation plate of the compressor such that the installation plate is exactly fixed at the time of assembling, and after the mounting of the compressor is completed, the installation plate is immovably fixed to the supporting rib.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An air conditioner comprising:

an indoor part for intaking indoor air to exchange heat with the intake air through an indoor heat exchanger, and again discharging the heat-exchanged air into an indoor space;

an outdoor part for intaking outdoor air to exchange heat with the intake air through an outdoor heat exchanger, and again discharging the heat-exchanged air into an outdoor space;

a base having parts constituting the indoor part and the outdoor part installed thereon; and a barrier integrated with the base, for partitioning an upper space of the base into the indoor part and the outdoor part.

2. The air conditioner of claim 1, wherein the barrier is further integrated with a shroud being protruded upwardly at one side of the outdoor side base to partition the upper section of the outdoor side base.

3. The air conditioner of claim 1, wherein the barrier is further integrated with a motor loading part being upwardly protruded at one side of the outdoor side base to load a motor thereon.

4. The air conditioner of claim 1, wherein the barrier is further integrated with a compressor loading part formed at one side of an upper surface of the outdoor side base to load a compressor thereon.

5. An air conditioner comprising:

an indoor part for intaking indoor air to exchange heat with the intake air through an indoor heat exchanger, and again discharging the heat-exchanged air into an indoor space;

an outdoor part for intaking outdoor air to exchange heat with the intake air through an outdoor heat exchanger, and again discharging the heat-exchanged air into an outdoor space;

a base having parts constituting the indoor part and the outdoor part installed thereon;

a barrier integrated with the base, for partitioning an upper space of the base into the indoor part and the outdoor part; and a shroud protruded upward of the outdoor side base, for partitioning an upper space of the outdoor side base.

6. The air conditioner of claim 5, wherein the shroud is separated into an upper side shroud and a lower side shroud, and the lower shroud is integrated with the outdoor side base.

7. The air conditioner of claim 6, wherein the upper side shroud is detachably installed on an upper side of the lower side shroud.

8. The air conditioner of claim 7, wherein the lower side shroud has vertical-extended reinforcing ribs at both side surfaces thereof.

9. The air conditioner of claim 8, wherein the reinforcing rib has an inverse-triangular type loading part for guiding mounting of the upper side shroud, at an upper portion thereof.

10. The air conditioner of claim 5, wherein the shroud has a circular through-hole, and an outdoor fan is provided for the through-hole.

11. An air conditioner comprising:

an indoor part for intaking indoor air to exchange heat with the intake air through an indoor heat exchanger, and again discharging the heat-exchanged air into an indoor space;

an outdoor part for intaking outdoor air to exchange heat with the intake air through an outdoor heat exchanger, and again discharging the heat-exchanged air into an outdoor space;

a base having parts constituting the indoor part and the outdoor part installed thereon;

a barrier integrated with the base, for partitioning an upper space of the base into the indoor part and the outdoor part; and a motor loading part upwardly protruded at one side of the outdoor side base, for loading a motor thereon.

12. The air conditioner of claim 11, wherein the motor loading part has a depressed recess part at an upper portion thereof.

13. The air conditioner of claim 11, wherein the motor loading part has a slit for introducing the outdoor air therethrough, at an outdoor side surface thereof.

14. An air conditioner comprising:

an indoor part for intaking indoor air to exchange heat with the intake air through an indoor heat exchanger, and again discharging the heat-exchanged air into an indoor space;

an outdoor part for intaking outdoor air to exchange heat with the intake air through an outdoor heat exchanger, and again discharging the heat-exchanged air into an outdoor space;

a base having parts constituting the indoor part and the outdoor part installed thereon;

a barrier integrated with the base, for partitioning an upper space of the base into the indoor part and the outdoor part; and a compressor loading part for loading a compressor at one side of an upper surface of the outdoor side base.

15. The air conditioner of claim 14, wherein the compressor loading part comprises:

fixed protrusions upwardly protruded at the one side of the upper surface of the outdoor side base to pass through an installation plate of the compressor;

a supporting rib provided between the fixed protrusions and having a loading groove at an upper surface thereof, the loading groove having a lower side end of the installation plate loaded on an upper surface thereof; and a flexible vibration protecting element having a central part through which the fixed protrusions pass, and provided between a lower surface of the installation plate and the base.

16. The air conditioner of claim 15, wherein a plurality of the supporting ribs is lined between the fixed protrusions.

17. The air conditioner of claim 15, wherein the fixed protrusion is formed of a metallic material to have one end fixedly inserted within the base.

18. The air conditioner of claim 15, wherein the fixed protrusion is integrated with the base.

19. The air conditioner of claim 15, wherein the base has a depressed part at a circumference of the fixed protrusion.

20. The air conditioner of claim 19, wherein the depressed part is shaped to be depressed as much as an area corresponding to the vibration protecting element to load the vibration protecting element thereon.

21. An air conditioner comprising:

an indoor part for intaking indoor air to exchange heat with the intake air through an indoor heat exchanger, and again discharging the heat-exchanged air into an indoor space;

an outdoor part for intaking outdoor air to exchange heat with the intake air through an outdoor heat exchanger, and again discharging the heat-exchanged air into an outdoor space;

a base having parts constituting the indoor part and the outdoor part installed thereon;

a barrier integrated with the base, for partitioning an upper space of the base into the indoor part and the outdoor part; and an air guide provided at a front surface of the barrier, for guiding an indoor part air and housing an indoor fan.

22. The air conditioner of claim 21, wherein the air guide comprises:

a bottom plate forming a bottom part;

a rear wall part having an inner surface rounded to guide air passing through an indoor heat exchanger;

a side wall part provided at both side ends of the rear wall part; and a fan support formed at the side wall part.

23. The air conditioner of claim 22, wherein the barrier has an indoor side front surface rounded backwardly and concavely, and the rear wall part is shaped to correspond to the barrier.

24. The air conditioner of claim 21, wherein the indoor side base having the indoor heat exchanger at a front lower side thereof has a condensed water channel for discharging condensate water, at a front lower side thereof.

25. The air conditioner of claim 21, wherein the indoor fan is comprised of a crossflow fan.

26. The air conditioner of claim 21, wherein the air guide has a control box for housing devices for controlling operation of the indoor part and the outdoor part at a side surface thereof, and the control box has a motor cover part at one lower side thereof to surround an upper portion of an indoor motor.

27. An air conditioner comprising:

an indoor part for intaking indoor air at a front surface thereof to again discharge the intake air at the front surface;

an outdoor part for intaking outdoor air at both side surfaces and at an upper and lower surfaces thereof to again discharge the intake air to a rear surface thereof; and a barrier for partitioning into an indoor part section and an outdoor part section.

* * * * *